US005406320A

United States Patent [19]

Durst et al.

[11] Patent Number: 5,406,320

[45] Date of Patent: Apr. 11, 1995

[54] INK REPLENISHMENT ASSEMBLIES FOR INK JET PRINTERS

[75] Inventors: Homer D. Durst, Springfield, Ohio; Sven Sonnenberg, Rochester, N.Y.

[73] Assignee: Scitex Digital Printing, Inc., Dayton, Ohio

[21] Appl. No.: 848,778

[22] Filed: Mar. 10, 1992

[51] Int. Cl.[6] ..... B41J 2/175

[52] U.S. Cl. ..... 347/86; 222/92; 222/105; 347/87

[58] Field of Search ..... 347/86, 87, 84, 85, 347/50, 56, 55, 36; 53/79, 86; 222/92, 93, 95, 96, 105, 566, 567, 569, 572, 574, 573

[56] References Cited

U.S. PATENT DOCUMENTS

| | | | |
|---|---|---|---|
| 4,314,264 | 2/1982 | Bok et al. . | |
| 4,568,954 | 2/1986 | Rosback | 347/86 |
| 4,591,875 | 5/1986 | McCann | 347/86 |
| 4,853,708 | 8/1989 | Walters | 347/86 |
| 5,138,344 | 8/1992 | Ujita | 347/86 |
| 5,216,452 | 6/1993 | Suzuki | 347/86 |
| 5,221,935 | 6/1993 | Uzita | 347/36 |
| 5,231,416 | 7/1993 | Terasawa et al. | 347/23 |
| 5,231,425 | 7/1993 | Masuda et al. | 347/87 |
| 5,245,360 | 9/1993 | Ebinuma et al. | 347/86 |
| 5,280,300 | 1/1994 | Fong et al. | 347/87 |
| 5,307,091 | 4/1994 | DeCoste, Jr. | 347/86 |

*Primary Examiner*—A. T. Grimley
*Assistant Examiner*—Thu Dang
*Attorney, Agent, or Firm*—Barbara Joan Haushalter

[57] ABSTRACT

The present invention constitutes in an ink jet printing apparatus, an improved ink replenishment system. An ink supply housing of the improved ink replenishment system includes a pair of opposed side walls having a plurality of attachments spaced in respective opposing vertical columns and detachable detents coupled to one of the attachments. An attachable ink supply conduit is associated an associated ink supply module includes a container of ink having an ink egress constructed to attach to the conduit, and a housing having bottom and side wall members supporting the container. The side walls have a vertical edge with a plurality of removable sections located in spaced relations corresponding to the column spacing of the attachments and sized to correspond to the detents. Only an ink supply module having proper sections removed can be moved into the housing to an extent sufficient for its egress to connect to the supply conduit.

3 Claims, 4 Drawing Sheets

INK REPLENISHMENT ASSEMBLIES FOR INK JET PRINTERS

FIELD OF INVENTION

The present invention relates to continuous ink jet printing apparatus and, more particularly, to ink replenishment assemblies for assuring that correct ink(s) are supplied into the ink circulation system(s) of such apparatus.

BACKGROUND ART

In continuous ink jet printing apparatus streams of uniformly spaced ink drops are created by imposing predetermined vibrations upon liquid ink filaments issuing from an orifice plate. The filaments are formed by supplying ink under pressure to a print head cavity that is in communication with the orifice plate. Information is imparted to the droplet streams by selective non-charging or charging and deflection of droplets. A portion of the droplets pass to the recording medium but there are a substantial number of non-printing droplets that are intercepted by a catcher for recirculation. Often the print head cavity has an outlet other than the orifice plate (e.g. to facilitate dynamic pressure control within the cavity at startup), and the apparatus ink supply system also circulates such ink flow.

Typically continuous ink jet printers include a large ink reservoir, to and from which ink is circulated by a pump. The reservoir is often maintained at subatmospheric pressure by a vacuum pump to effect return of ink from the print head and/or catcher. U.S. Pat. No. 4,314,264 discloses one such ink circulation system and it will be appreciated that a multicolor printing apparatus can have a plurality of these systems. In such printers, it is very important that ink for one color system not be introduced into another and vice versa. In addition, inks are generally water-based or solvent-based and it is equally catastrophic if those two ink types are inadvertently intermixed.

There are many opportunities for incorrect ink mistakes to happen because ink must be replenished to the circulation system fairly frequently. Similar problems exist for circulation systems wherein the main ink reservoir is a removable ink cartridge, e.g. see U.S. Pat. No. 4,591,875. To avoid the coupling of improper ink cartridges to the circulation systems of a multicolor printer, U.S. Pat. No. 4,853,708 provides a keyed, apparatus-ink cartridge interface system. In that system each housing of the printer is fitted with its own unique pin configuration and cartridges having a particular ink are formed with plug and hole configurations such that the cartridge will interfit only in the proper housing.

The concept described in the '708 patent is very useful; however, it would be desirable to have systems of this kind that are improved from the viewpoints of simplicity of fabrication and assembly and to provide more tolerance in the interfit interfaces of the printer housing and ink supply module.

SUMMARY OF INVENTION

Thus, one important object of this invention is to provide a simple ink-supply-module/printer-housing assembly which prevents insertion of incorrect replenishment inks into the circulation systems of ink jet printers. The present invention has advantages from the viewpoint of cost of fabrication and from the viewpoint of constructional tolerances.

In one aspect the present invention constitutes in an ink jet printing apparatus, an improved ink replenishment system comprising:

an ink supply housing including: (i) a pair of opposed side walls having a plurality of attachment means spaced in respective opposing vertical columns and detachable detent means coupled to one of the attachment means; and (ii) means housing an attachable ink supply conduit; and an ink supply module including: (i) a container of ink having an ink egress constructed to attach to the conduit; and (ii) a housing having bottom and side wall members supporting the container, the side walls having a vertical edge with a plurality of removable sections located in spaced relations corresponding to the column spacing of the attachment means and sized to correspond to the detent means; whereby only an ink supply module having proper sections removed can be moved into the housing to an extent sufficient for its egress means to connect to the supply conduit.

In another aspect the present invention constitutes an ink supply module for use in such an ink jet printer.

BRIEF DESCRIPTION OF DRAWINGS

The subsequent description of preferred embodiments refers to the accompanying drawings wherein.

DETAILED DESCRIPTION OF PREFERRED EMBODIMENTS

Figure 1:
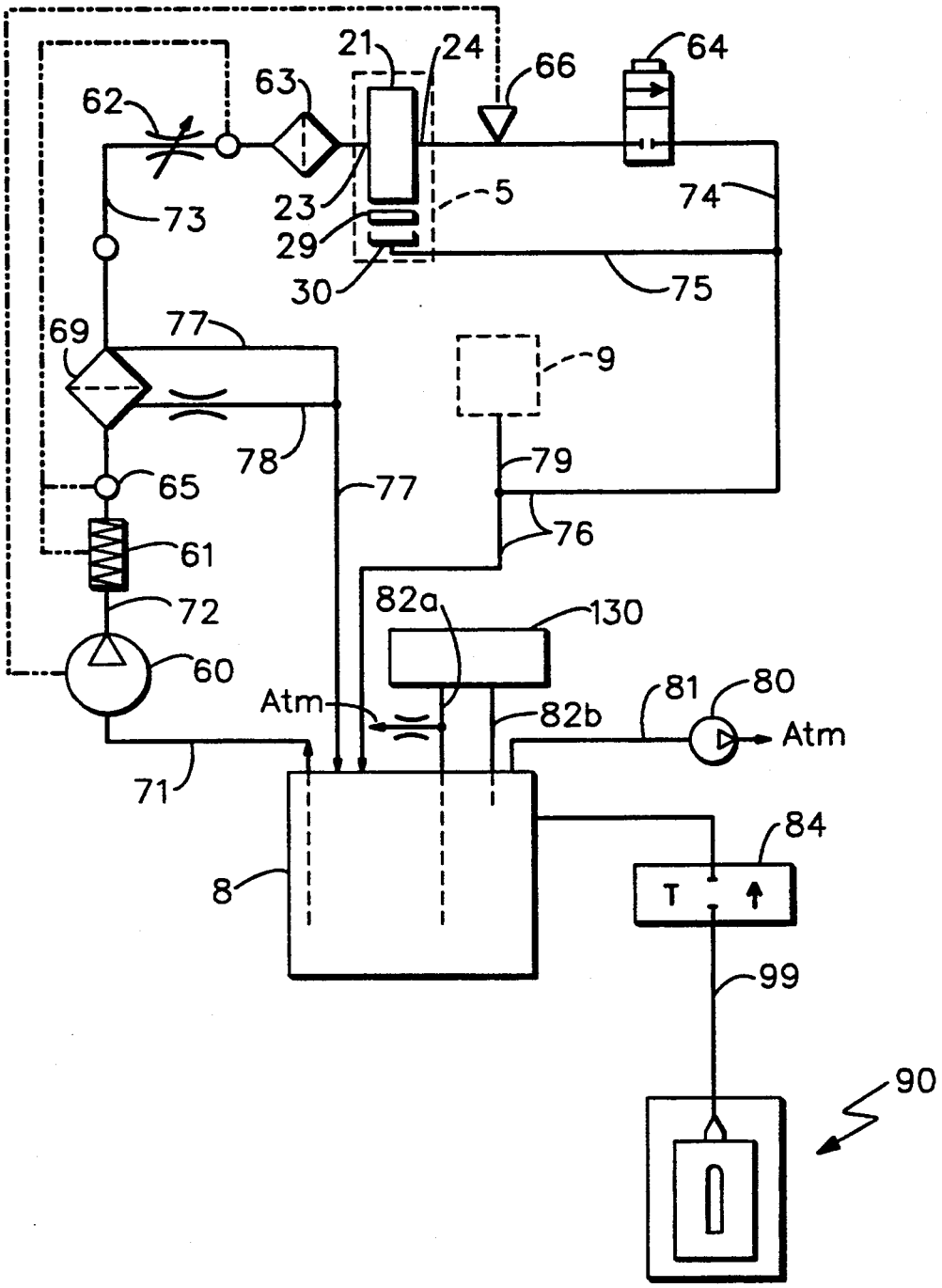
FIG. 1 is a schematic illustration of the ink circulation system of one ink jet printer apparatus incorporating the replenishment assembly of the present invention.

FIG. 1 schematically illustrates the ink circulation of one ink jet printing apparatus which can incorporate the present invention. In that printer, the print head assembly 5 includes an upper portion and a lower portion. The upper portion can include a print head body 21 having an inlet 23 for receiving ink. The body 21 can comprise a passage leading to a print head cavity, the orifice plate structure of the printer (not shown) and the print head outlet 24. The upper print head portion also includes a suitable transducer means (not shown) for imparting mechanical vibration to the body, to assure break-up of the ink into streams of uniformly spaced ink droplets.

The lower portion of print head assembly 5 includes a charge plate 29 constructed to impart desired charge upon ink droplets at the point of breakup and a drop catcher 30 that is constructed and located to catch non-printing copies (in this arrangement charged droplets).

The ink supply and circulation system shown in FIG. 1 includes various ink conduits or "lines" which form the ink circulation path. Specifically, pump inlet line 71 extends from ink supply reservoir 8 to the inlet of pump 60, pump outlet line 72 extend between pump 60 and main filter 69, head supply line 73 extends from main filter 69 to the print head inlet and head return line 74 extends from the print head outlet to a junction between catcher return line 75 and the main ink return line 76. The main return line 76 is also connected to home station return line 79. An air bleed line 78 and an ink bypass line 77 extend from main filter 61 back to reservoir 8. A vacuum pump 80 is coupled to the reservoir interior via conduit 81 to facilitate ink return via line 76. Other elements of the system include ink heater 61, variable flow restrictor 62, final filter 63, heat return valve 64, temperature sensor(s) 65, pressure sensor 66, and level detector 130.

The level detector can be of the kind described in U.S. Pat. No. 4,591,875 or of other design; and upon detection of a low supply of ink in reservoir 8, the fill valve 84 is actuated to provide new ink into the system from the ink replenishment source 90 constructed in accord with the present invention.

Figure 2:
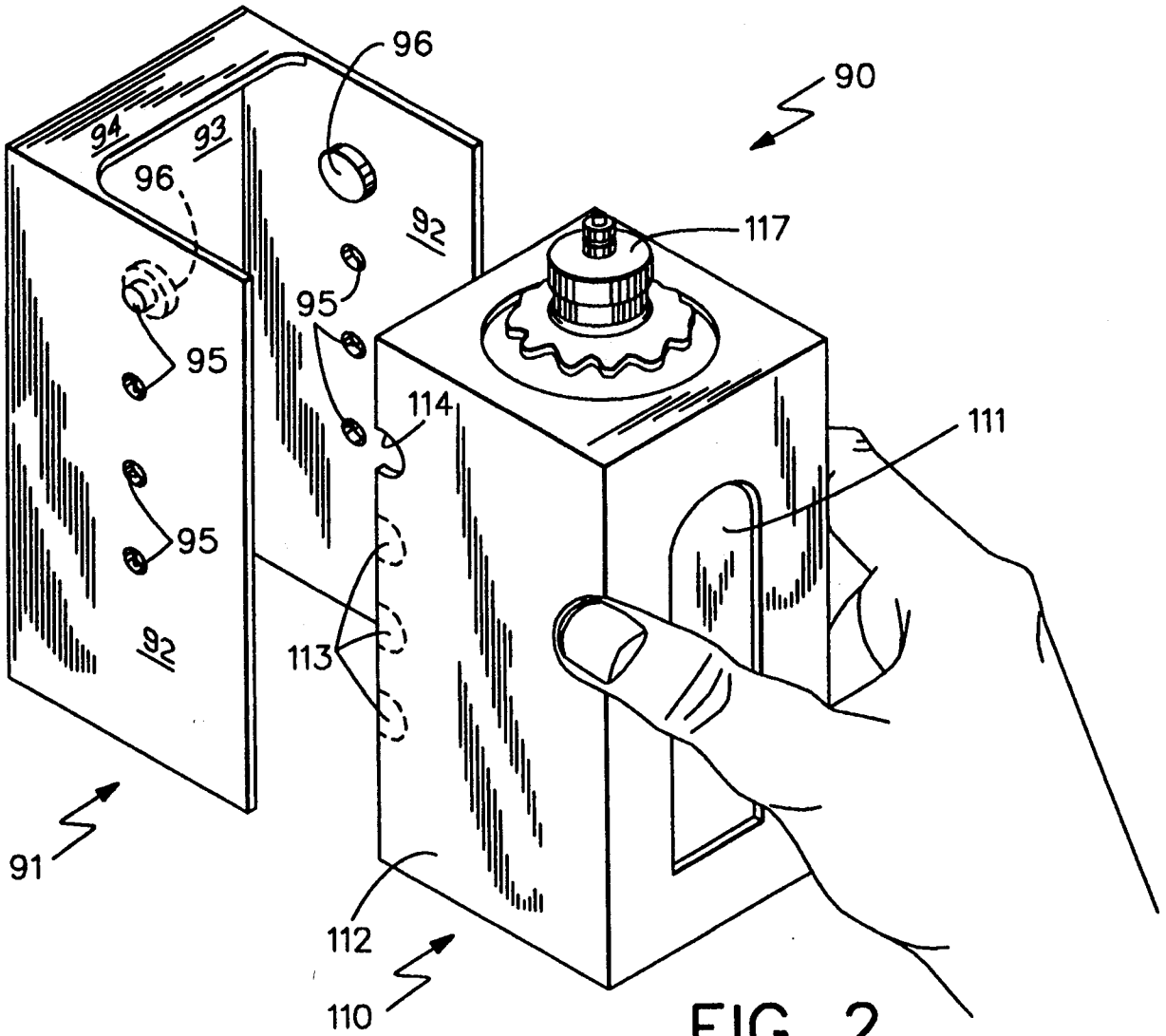
FIG. 2 is a perspective view of one preferred construction for the ink supply module and printer replenishment housing according to the present invention.
Figure 4:
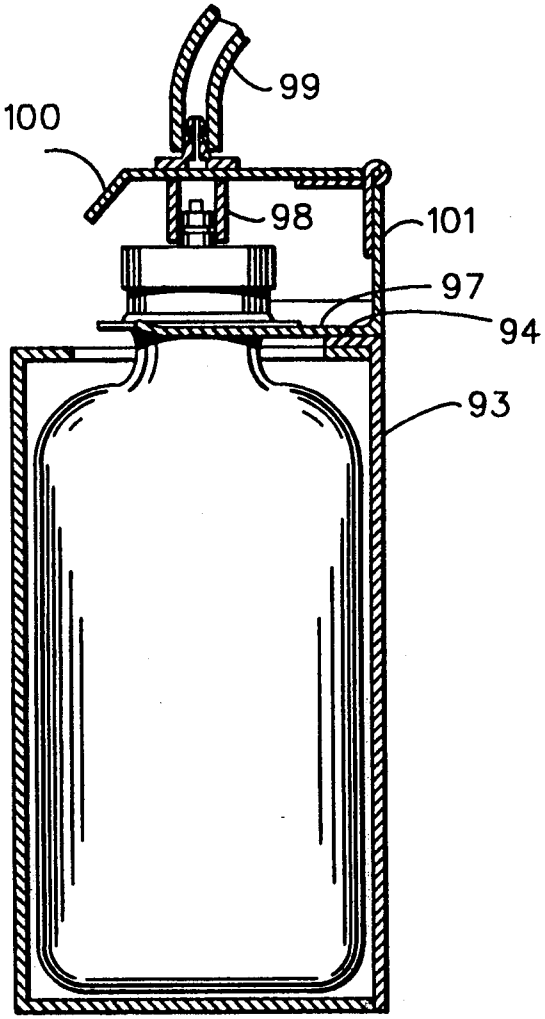
FIG. 4 is a cross-sectional side view of the FIG. 3 printer housing.
Figure 3:
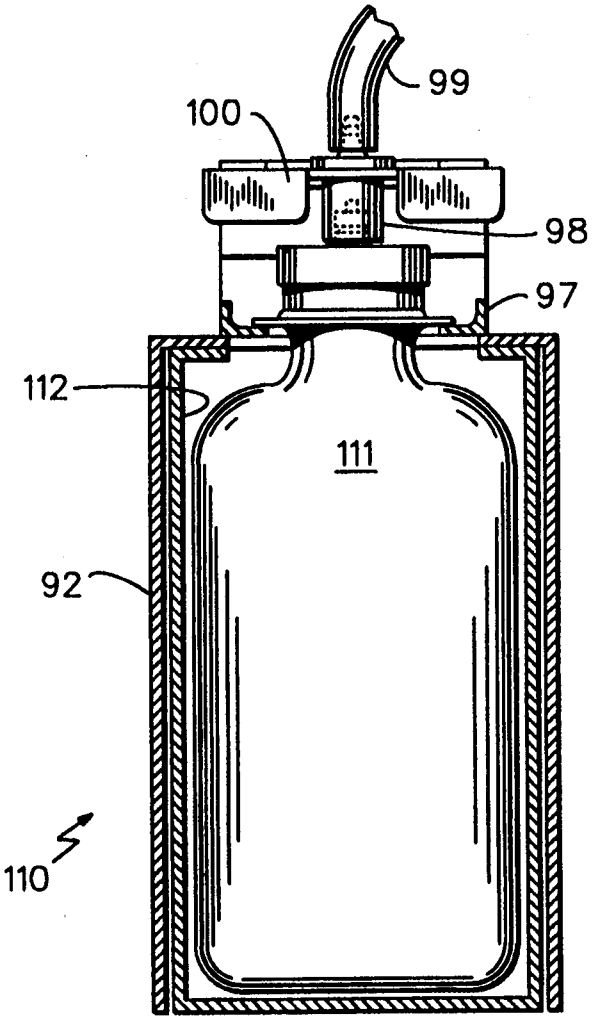
FIG. 3 is a front view of the FIG. 2 printer housing with ink supply module inserted.
Figure 5A:
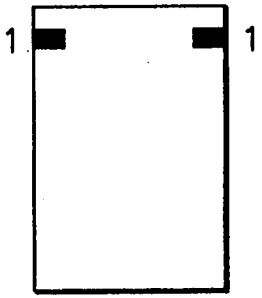
FIGS. 5A–5H are diagrams illustrating one preferred encoding system according to the present invention.
Figure 5B:
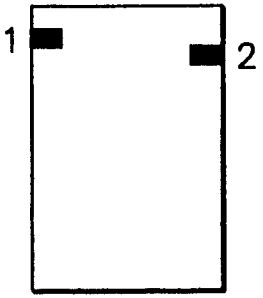
Figure 5C:
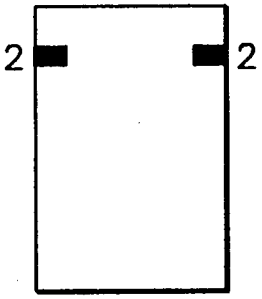
Figure 5D:
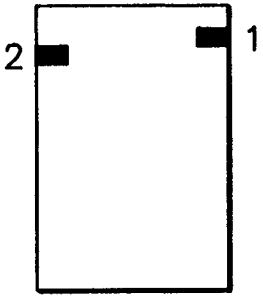
Figure 5E:
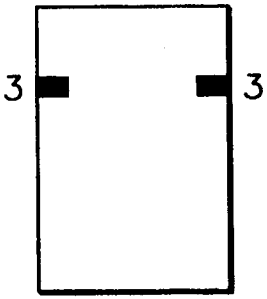
Figure 5F:
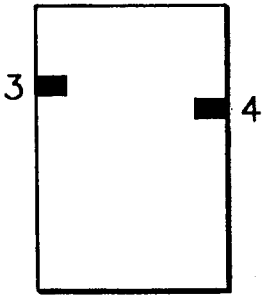
Figure 5G:
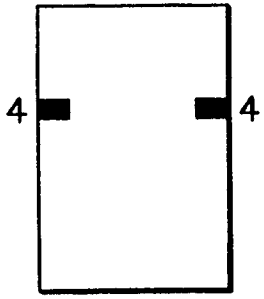
Figure 5H:
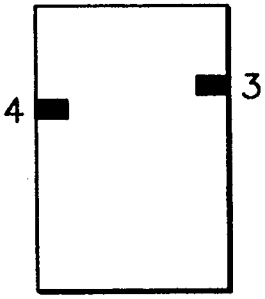

Referring to FIGS. 2–4 the replenishment system 90 is shown in more detail to comprise a printer ink supply housing 91 having a pair of opposed side walls 92, a rear wall 93 and a top wall 94. The side walls each have a plurality of holes 95 forming opposing vertical columns of spaced attachment means, for receiving snap-in pins 96. Top wall 94 supports a U-shaped member 97 constructed to interfit with the neck of an inserted ink supply module and hold the module in a position to be connected to the fluid coupling 98 of ink replenishment conduit 99. The coupling 98 is mounted on a lever arm 100 which is pivotally connected to an upward extension 101 of U-shaped member 97.

The housing 91 is sized to receive ink module 110 as shown in FIGS. 2–4. The module 110 comprises a collapsible plastic container 111 having a top 117 through which contained ink can be withdrawn. The container is packaged in a cardboard box 112 with edges having a plurality of perforated regions 113 are constructed to be selectively punched out to form notches 114. The notches are sized and configured to interfit with pins 96, located along the rear portion of the walls 92 of housing 91.

As best shown in FIG. 2, the selective removal of notches 114 can cooperate with the selective placement of attachment means 96 in housing 91 to enable only the proper ink to be coupled to the inlets 98 to the fluid system. That is, if the top notches 114 of the ink unit 110 were not removed the unit would not be insertable into the housing of FIG. 2 (keyed with the top attachment members 96) to an extent enabling the coupling 98 to engage the top 117 of ink container 111. FIGS. 5A–5H indicate the other variations which can be accomplished to selectively encode the housing/reservoir systems for eight different kins of ink, e.g. different colors or different ink base media.

The invention has been described in detail with particular reference to certain preferred embodiments thereof, but it will be understood that variations and modifications can be effected within the spirit and scope of the invention.

We claim:

1. In an ink jet printing apparatus, an improved ink replenishment system comprising:

(a) an ink supply housing including:

(i) a pair of opposed side walls, each having a plurality of attachment means spaced in respective opposing vertical columns and detachable detent means attached to at least one of the attachment means in each of said columns;

(ii) a rear wall generally parallel to said vertical columns; and (iii) top wall means housing an attachable ink supply conduit; and (b) an ink supply module including:

(i) a collapsible container of ink having an ink egress means constructed to attach to said ink supply conduit; and (ii) a box member having bottom and side wall members supporting said container, said side walls each having a vertical edge with a plurality of removable sections located in spaced relations corresponding to the column spacing of the attachment means and sized to correspond to said detent means;

whereby only an ink supply module having proper sections removed can be moved into said housing to an extent sufficient for its egress means to attach to said supply conduit.

2. In an ink jet printing apparatus, an improved ink replenishment system comprising:

(a) an ink supply housing including:

(i) a pair of opposed side walls, each having a plurality of attachment means spaced in respective opposing vertical columns and detachable detent means attached to at least one of the attachment means;

(ii) means housing an attachable ink supply conduit; and (b) an ink supply module including:

(i) a container of ink having an ink egress means constructed to attach to said ink supply ink supply conduit; and (ii) a member having bottom and side wall members supporting said container, said side walls having a vertical edge with a plurality of removable sections located in spaced relations corresponding to the column spacing of the attachment means and sized to correspond to said detent means;

whereby only an ink supply module having proper sections removed can be moved into said housing to an extent sufficient for its egress means to attach to said supply conduit.

3. For use an ink jet printing apparatus having an ink supply housing including: a pair of opposed side walls, each having a plurality of attachment means spaced in respective opposing vertical columns and detachable detent means attached to at least one of the attachment means; and means housing an attachable ink supply conduit, an ink supply module comprising:

(a) a container of ink having an ink egress means constructed to attach to said ink supply conduit, and (b) a housing member having bottom and side wall members supporting said container, said side walls having a vertical edge with a plurality of removable sections located in spaced relations corresponding to the column spacing of the attachment means and sized to correspond to said detent means; whereby only an ink supply module having proper sections removed can be moved into said housing to an extent sufficient for its egress means to attach to said supply conduit.

* * * * *